United States Patent [19]

Dykast et al.

[11] Patent Number: 4,584,833

[45] Date of Patent: Apr. 29, 1986

[54] APPARATUS FOR EMERGENCY INTERRUPTION OF FIBER SUPPLY TO A SPINNING UNIT OF OPEN-END SPINNING MACHINES

[75] Inventors: Jaroslav Dykast; František Cáda, both of Usti n/Ori; Miroslav Kubovy, Dolni Dobouc, all of Czechoslovakia

[73] Assignee: Vyzkumny ustav bavlnarsky, Usti n/Ori, Czechoslovakia

[21] Appl. No.: 648,724

[22] Filed: Sep. 7, 1984

[30] Foreign Application Priority Data

Sep. 13, 1983 [CS] Czechoslovakia ..... 6664-83

[51] Int. Cl.[4] ..... D01H 13/14; D01H 1/135

[52] U.S. Cl. ..... 57/405; 57/81; 57/83; 57/408

[58] Field of Search ..... 57/78, 80, 81, 83, 405, 57/404, 408, 263

[56] References Cited

U.S. PATENT DOCUMENTS 3,334,479 8/1967 Kikulecky et al. ..... 57/405 X
3,354,631 11/1967 Elias et al. ..... 57/263
3,492,804 2/1970 Landwehrkamp et al. ..... 57/80
3,540,201 11/1970 Susami et al. ..... 57/405 X

FOREIGN PATENT DOCUMENTS 2212106 11/1972 Fed. Rep. of Germany .
2214006 11/1972 Fed. Rep. of Germany .
2137782 12/1972 France .

*Primary Examiner*—John Petrakes

[57] ABSTRACT

This invention relates to an apparatus for emergency fiber supply to a spinning unit in an open-end spinning machine. According to the invention, a sensing unit controls an electromagnetic coupling and fiber supply device, such that a break in the yarn is rapidly detected and the fiber supply is immediately disengaged, even if the conventional thread breakage detector fails.

A sensing unit is disposed in that portion of the wall of a cover that extends into the spinning rotor interior. It is adapted to respond to the excess accumulation of unspun fibers and/or an undue increase in temperature by disconnecting the electromagnetic fiber supply coupling via the thread breakage detector circuit to which it is connected. The sensing unit can be a pressure sensitive microswitch, a bimetallic relay, a thermistor, or a combination of these elements.

8 Claims, 3 Drawing Figures

APPARATUS FOR EMERGENCY INTERRUPTION OF FIBER SUPPLY TO A SPINNING UNIT OF OPEN-END SPINNING MACHINES

This invention relates to an apparatus for emergency fiber supply to a spinning unit in an open-end spinning machine. According to the invention, a sensing unit controls an electromagnetic coupling and fiber supply device, such that a break in the thread is rapidly detected and the fiber supply is immediately disengaged, even if the conventional thread breakage detector fails.

BACKGROUND OF THE INVENTION

Emergency thread supply devices are known in the art to employ an electromagnetic thread breakage detector coupled to a mechanical arm. The arm is engaged by yarn withdrawn from the spinning unit by feed rollers. When a break in the yarn occurs, the arm swings from a normal operating position to an emergency operating position, triggering a reed relay in the process. The relay disengages the electromagnetic coupling that drives the fiber supply.

The electric thread breakage circuit is usually protected from short circuit by a thermal fuse, but there are circumstances when this safeguard is insufficient. If the thread breakage circuit malfunctions to the extent that the reed relay is not closed, the device will fail to disengage the fiber supply. This in turn will cause the rapid and dangerous accumulation of highly flammable fiber. In such a case, the fiber is continuously provided by the electromagnetic coupling but no fiber is consumed by the spinning machine because of the essentially undetected break.

West German published application DE-OS No. 2,214,066 discloses a safety system comprising a thermal fuse connected to the electric circuit of an electromagnetic fiber supply coupling. A two-arm lever is associate with the fuse such that the fiber supply is disengaged even when the breakage detector fails or short circuits. The thermal fuse in turn is controlled by the transfer of heat from the spinning rotor interior via a heat conductor. This system suffers from a number of disadvantages. It is complicated and often unreliable in practice, because a relatively large swing of the two-arm lever is required to trigger the interrupt, without regard for the potential combustion of accumulated thread. Heat is conducted to the thermal fuse slowly, and the system therefore fails to react quickly in the event of a fire in the choked spinning rotor.

Another thermal fuse safety device is disclosed in West German published application DE-OS No. 2,212,106. In this arrangement, a pair of resistors are connected to a fiber supply current source in series with a switch element and a thermal fuse. A thermal sensor connected to one of the resistors is disposed within the spinning mechanism. The sensor responds to the rise in temperature caused by friction of the accumulated fiber, and this disconnects the resistor and interrupts the entire circuit. However, the system remains relatively complicated and responds too slowly.

SUMMARY OF THE INVENTION

It is an object of the present invention to provide a rapid and reliable emergency interrupt device capable of disengaging the spinning rotor fiber supply in the event of thread breakage. In particular, the invention provides for an early yet intelligent interrupt, so that the accumulation of excess fibers after a break does not become dangerous. The device is designed to interrupt the feed supply long before fiber accumulation and spinner friction reach the point of combustion.

According to the invention, the spinning rotor is provided with a slipping wall that may be closed by a cover. A duct supplies the rotor with fibers from a fiber supply device controlled by an electromagnetic coupling. The coupling is connected to a thread breakage detector having a reed relay. A sensing unit is placed in that portion of the wall cover that extends into the spinning space of the rotor. In the event that the thread breakage detector fails, the sensing unit is available to respond to both excess accumulation of fiber and increases in temperature, thereby disengaging the fiber supply as needed.

A rapid interrupt response is particularly important when spinning coarse yarns that require large amounts of fiber. An immediate interrupt response to changes in the critical state of the spinning space is also particularly advantageous when used with open-end spinning machines that traditionally operate around the clock with little supervision. The present invention achieves this objective by means of several improvements over the art.

First, the sensing unit is electrically interconnected with the thread breakage detector and the reed relay. In this way, conventional spinning and interrupt apparatus can be adapted to safer use, because failure of the thread breakage detector can itself be set to trigger the interrupt.

Second, the sensing unit includes a pressure sensitive microswitch disposed in a portion of the wall cover within the spinning rotor interior and opposite the sliding wall. Accumulation of fiber at the sliding wall where it merges into the collecting channel of the spinning rotor exerts a pressure to which the sensing unit responds. In this fashion, the fiber supply can be disengaged long before accumulation and rotor friction become dangerous.

Third, the sensing unit incorporates an inexpensive and reliable bimetallic heat-sensitive relay adapted to respond rapidly to overheating in the spinning space. The relay can be adapted to a relatively low temperature, such as 60° C., so that the fiber supply may be interrupted through overheating problems not necessarily associated with failure of the thread breakage detector.

The invention can be readily adapted for use in electronically controlled spinning units by interconnecting a thermistor of the sensing unit with the electronic control system, so that a timely interrupt signal can be sent to the control system.

The arrangement as herein disclosed is also advantageously adapted to open-end spin-twisting or core-twisting units prone to "half-breakage," where breakage of one of many yarn components does not trigger the interrupt in known devices. Here, the interrupt will be triggered by fiber accumulation and increased temperature, even if the conventional thread breakage detector fails to respond to the "half-breakage."

The invention responds almost as quickly as the conventional breakage detector it is designed to supplement, thereby increasing the safety and efficiency of the spinning machine.

A number of preferred embodiments of the invention are described below, with reference to several drawings. It will be appreciated by those skilled in the art that the examples and the drawings are illustrative, and do not serve to limit the scope of the invention.

DETAILED DESCRIPTION

Figure 1:
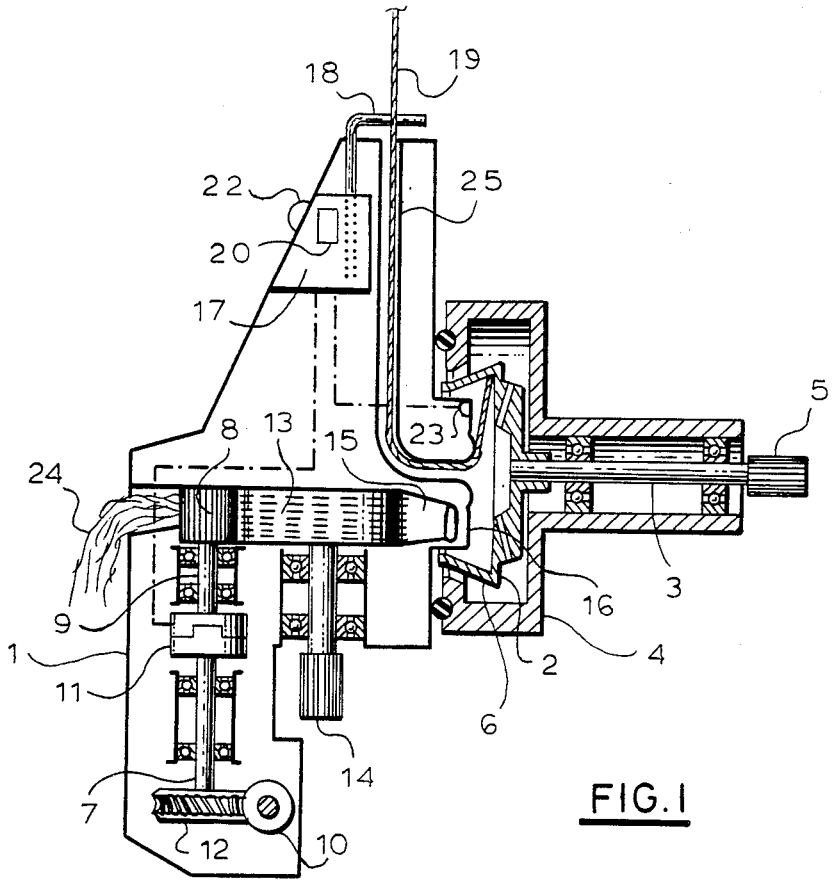
FIG. 1 is a sectional view of a spinning unit.

With reference to FIG. 1, the spinning unit 1 comprises a spinning rotor 2 mounted on central shaft 3 and driven within spinning rotor 2 by a belt engaged by first pulley 5. The casing 4 has a slipping wall 6. Fiber supply device 7 is located within the spinning unit 1 and feeds fibrous material 24 into the machine through a feed roller 8. Shaft 9 of roller 8 is driven by worm gear 10, through an electromagnetic coupling 11 and a gear wheel 12. As viewed in the direction of flow, feed roller 8 is followed by fiber separating cylinder 13, the shaft of which carries a second pulley 14 for belt driving. A recess in the housing of spinning unit 1 accommodates the separating cylinder 13 and merges into fiber supply duct 15. The separated fibers are conveyed by duct 15 to cover 16, which closes the open side of spinning rotor 2.

Thread breakage detector 17 has an electric circuit and is mounted above the spinning rotor 2. The detector 17 has a swing arm 18, which sits in operational contact with yarn 19. Swing arm 18 has a rotatable stem to which a permanent magnet 20 is attached. Magnet 20 is positioned for contactless switching of reed relay 21 (shown in FIG. 2). A luminous signal diode 22 is shown within the circuit of the thread breakage detector, as is sensing unit 23.

Figure 2:
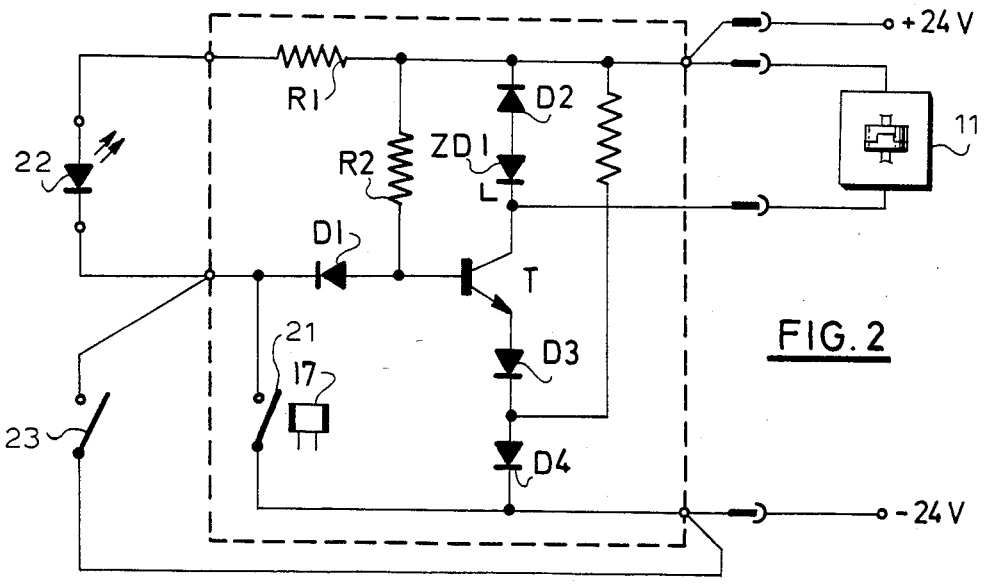
FIG. 2 is a wiring diagram showing the interconnection of the sensor unit in the electric thread breakage circuit.

FIG. 2 shows a circuit diagram of the present invention, wherein the sensing unit 23 is interconnected with the thread breakage detector 17. Resistors R, diodes D and transistor T are shown. The electromagnetic coupling 11 is interconnected as shown with the sensing unit 23, which is housed in a part of cover 16, facing slipping wall 6.

In operation, fibrous material 24 is fed to spinning unit 1 by fiber supply device 7 via feed roller 8, where the material is separated into discrete fibers by a needled surface on the rotating cylinder 13. The fibers then pass through supply duct 15, and through cover 16 of spinning rotor 2.

Fibers within spinning rotor 2 are deposited along the maximum periphery of slipping wall 6 in the form of a fibrous ribbon, the ribbon being twisted in a known manner to form yarn 19. The yarn 19 is withdrawn from the open end of spinning rotor 2 through exit tube 25, the mouth of which is within cover 16.

Shaft 9 of feed roller 8 is driven by electromagnetic coupling 11, gear wheel 12 and worm gear 10. Electromagnetic coupling 11 is connected to the electric circuit of thread breakage detector 17. The switch contact of reed relay 21 is disconnected during the spinning process so that electromagnetic coupling 11 is supplied with current via transistors $T_1$ and diodes $D_3$ and $D_4$. Fiber is fed to the spinning rotor 2, and luminous diode 22 gives no signal.

If yarn 19 breaks, arm 18 swings out so that permanent magnet 20 approaches reed relay 21, whereby the circuits through transistor T and luminous diode 22 are closed and thread breakage is indicated. The current supply to electromagnetic coupling 11 is interrupted so that the feed of fibrous material 24 by feed roller 8 is stopped.

A pressure sensitive microswitch may be placed within the sensing unit 23, in the wall of cover 16 and facing the slipping wall 6. Pressure exerted on the wall of cover 16 by the accumulation of unspun fibrous material in spinning rotor 2 will close the switch contacts and thereby disengage the feed roller 8 by cutting off the current to electromagnetic coupling 11. At the same time, luminous diode 22 signals that the feed roller 8 has been stopped.

A bimetallic relay may be placed within the sensing unit 23, in the wall of cover 16, the relay adapted to respond to spinning machine malfunctions accompanied by an increase in temperature. The accumulation of unspun fibers and/or excess friction of the spinning roller 2 are two such malfunctions. If spinning unit 1 overheats, the contacts of the bimetallic relay are closed. This disengages feed roller 8 by removing current from electromagnetic coupling 11, and luminous diode 22 is simultaneously triggered.

Figure 3:
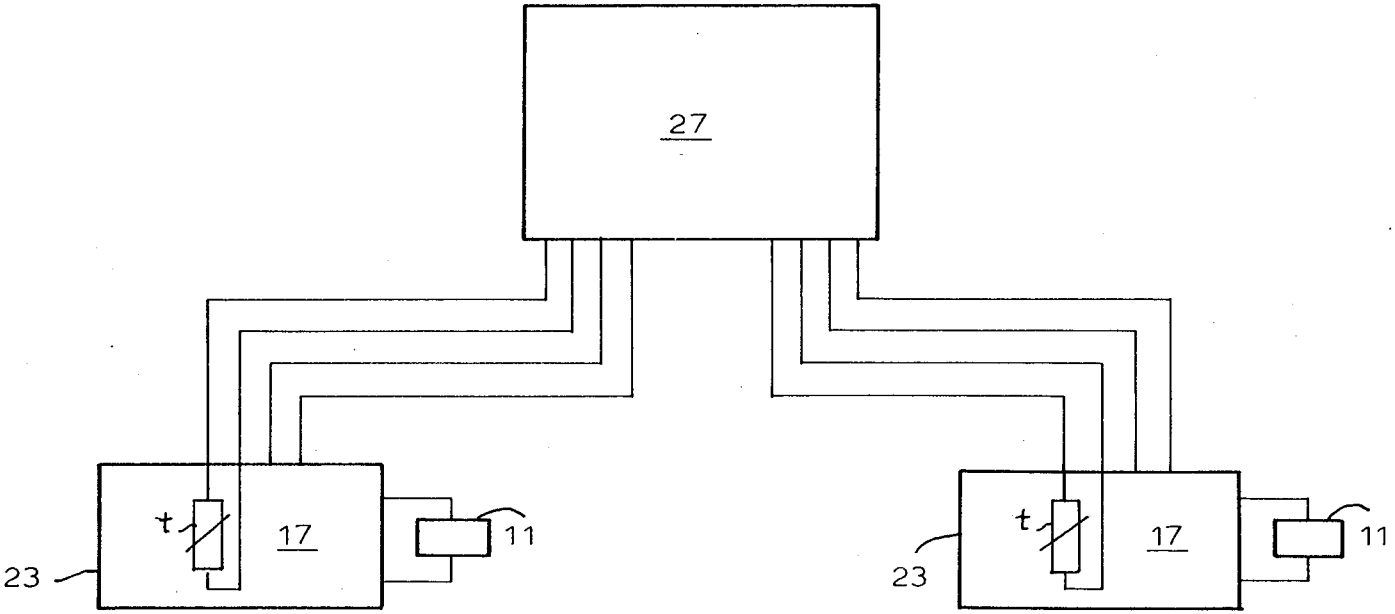
FIG. 3 is a sectional view of a spinning unit, showing interconnection with a central control circuit.

A thermistor t may be placed within the sensing unit 23. The thermistor responds to elevated temperatures in spinning rotor 2 by a change in resistance. The thermistor resistance is evaluated by central control unit 27 (FIG. 3), and at a predetermined resistance/temperature level the control unit 27 transmits an electric pulse whereby electromagnetic coupling 11 is deprived of current and feed roller 8 is stopped. Luminous diode 22 is simultaneously triggered to indicate failure of the spinning unit 1. In addition, an audio signal can be generated to announce the failure.

The arrangement of the present invention provides an inexpensive and reliable device for safeguarding open-end spinning machines from failures which cannot be responded to, either in time or at all, by the conventional thread breakage detector.

We claim:

1. In an apparatus for the emergency interruption of an open-end spinning machine having
   - a spinning rotor having a slipping wall and closeable by a cover; a fiber supply device;
   - means for driving the fiber supply device;
   - an electromagnetic coupling interposed between the means for driving the fiber supply device and the fiber supply device;
   - an electric thread breakage detector;
   - the thread breakage detector being supplied by an electric circuit in which there is interposed a reed relay;
   - the improvement comprising
   - a sensing unit disposed within that portion of the wall of the cover that extends into the spinning space of the spinning rotor, the sensing unit being adapted to respond to the accumulation of excess of unspun fibers in the rotor spinning space by opening the reed relay to de-energize the electromagnetic coupling, whereby to disengage the fiber supply device in case of an emergency even if the thread breakage detector fails.

2. In an apparatus for the emergency interruption of an open-end spinning machine having
   - a spinning rotor having a slipping wall and closeable by a cover; a fiber supply device;
   - means for driving the fiber supply device;

an electromagnetic coupling interposed between the means for driving the fiber supply device and the fiber supply device;

an electric thread breakage detector;

the thread breakage detector being supplied by an electric circuit in which there is interposed a reed relay;

the improvement comprising a sensing unit disposed within that portion of the wall of the cover that extends into the spinning space of the spinning rotor, the sensing unit being adapted to respond to a predetermined temperature increase in the rotor spinning space by opening the reed relay whereby to de-energize the electromagnetic coupling thus to disable the fiber supply device in case of an emergency, even if the thread breakage detector fails.

3. In an apparatus for the emergency interruption of an open-end spinning machine having a spinning rotor having a slipping wall and closeable by a cover; a fiber supply device;

means for driving the fiber supply device;

an electromagnetic coupling interposed between the means for driving the fiber supply device and the fiber supply device;

an electric thread breakage detector;

the thread breakage detector being supplied by an electric circuit in which there is interposed a reed relay;

the improvement comprising a sensing unit disposed within that portion of the wall of the cover that extends into the spinning space of the spinning rotor, the sensing unit being adapted to respond to both the accumulation of excess unspun fibers and a predetermined temperature increase in the spinning rotor space by opening the circuit connected to the electromagnetic coupling to disengage the fiber supply device in case of an emergency, even if the thread breakage detector fails.

4. An improved apparatus as in claim 2, comprising an electronic central control unit which monitors the operation of the spinning machine, and wherein the sensing unit comprises a thermistor connected to the electronic central control unit.

5. An improved apparatus as in claim 1 wherein the sensing unit is electrically connected to the reed relay of the thread breakage detector, such that the emergency response of the sensing unit is to disconnect the electromagnetic coupling and thereby disengage the fiber supply device.

6. An improved apparatus as in claim 1 wherein the sensing unit comprises a bimetallic relay.

7. An improved apparatus as in claim 1 wherein the sensing unit comprises a pressure sensitive microswitch.

8. An improved apparatus as in claim 1 wherein the sensing unit comprises a pressure sensitive microswitch and a bimetallic relay.

* * * * *